US005148462A

United States Patent [19]

Spitsyn et al.

[11] Patent Number: 5,148,462

[45] Date of Patent: Sep. 15, 1992

[54] HIGH EFFICIENCY X-RAY ANODE SOURCES

[75] Inventors: Boris Spitsyn; Valery Efanov; Leonid Bouilov; Alexander Aleksenko; Anantolij Botev, all of Moscow, U.S.S.R.; Terje Skotheim, Shoreham, N.Y.

[73] Assignee: Moltech Corporation, Stony Brook, N.Y.

[21] Appl. No.: 682,146

[22] Filed: Apr. 8, 1991

[51] Int. Cl.[5] ..... H01J 35/08

[52] U.S. Cl. ..... 378/143; 378/121; 378/124

[58] Field of Search ..... 378/121, 119, 125, 127, 378/128, 129, 143, 144

[56] References Cited

U.S. PATENT DOCUMENTS

| | | | |
|---|---|---|---|
| 4,266,138 | 5/1981 | Nelson, Jr. et al. | 378/143 |
| 4,573,185 | 2/1986 | Lounsberry et al. | 378/144 |
| 4,972,449 | 11/1990 | Upadhya et al. | 378/144 |

*Primary Examiner*—David P. Porta
*Attorney, Agent, or Firm*—Roland Plottel

[57] ABSTRACT

The present invention relates to the formation of high thermal conductivity X-ray anode sources for the production of high intensity X-rays. The anode sources are structures containing diamond (passive element) and desired target material(s) consisting of metal(s) and (or) their alloys for the generation of high intensity X-radiation of the desired wavelength.

6 Claims, 2 Drawing Sheets

HIGH EFFICIENCY X-RAY ANODE SOURCES

BACKGROUND OF THE INVENTION

1. Field of the Invention

The invention relates to use of structures composed of diamond with metals and/or their compounds, for the formation of both static and dynamic X-ray anodes.

2. Description of the Prior Art

High power X-ray sources are desirable for applications such as X-ray lithography, X-ray tomography, X-ray transmission and interference microscopy and high resolution X-ray Photoelectron Spectroscopy (XPS). The intensity of X-ray tube sources are currently limited largely by the thermal conductivity and temperature of melting/sublimation of anode materials and formation of high density electron beams. Recently, other techniques such as synchrotron sources and laser plasma sources have emerged as alternate sources of high intensity X-rays. However, such methods are considerably more expensive and cumbersome in comparison to conventional X-ray tube technologies. Consequently, a high power X-ray anode source is highly desirable.

An X-ray tube usually consists of an anode and an electron-emitting cathode. A small fraction of the electrons bombarding a portion of the anode known as the anode target, cause excitation of target atoms. The energy released during the de-excitation process is sometimes emitted as X-rays. However, most of the energy imparted by electron bombardment is absorbed as heat. The intensity of X-ray production is therefore limited largely by the efficiency of heat dissipation from the anode. Consequently, a large fraction of the research in X-ray tubes has been devoted to schemes of efficiently cooling X-ray anodes by coupling rotation and flow cooling.

Other improvements in increasing the intensity of X-ray sources include anode designs aimed at increasing the efficiency of generated X-rays by using the internal surfaces of a bored anode for the generation and collimation of X-rays (U.S. Pat. No. 4,675,890). In this case electron beams enter one end of the bore and collimated X-rays are generated from the other end. Intensity of generated X-rays can also be further improved by use of X-ray focussing optics.

The major advances in X-ray tube technology have been brought about in the area of efficient rotation (for example, U.S. Pat. Nos. 4,651,336 and 4,608,707) and flow cooling schemes and in efficient use of generated X-rays. Little attention has been paid to the material properties of the anode itself. One proposed scheme relating to anode materials for generation of high intensity carbon X-rays consists of powdered diamond particles embedded in metal/alloys (Japanese patent 55-115024). Alternately it was suggested that thin diamond layers formed on metals could be used for generation of high intensity carbon X-rays (Japanese patent 55-115024). Another scheme proposes using single crystal diamond sources for the production of soft X-rays for high resolution X-ray lithography (J. Appl. Phys. Vol. 49, p 5365–5367). However, these methods have several drawbacks. A shortcoming of diamond sources is the lack of suitable window materials for the efficient transmission of carbon K radiation. Moreover, use of single crystal diamonds is not desirable from the point of view of thermomechanical stresses created at high levels of energy conversion.

The extremely high thermal conductivity of diamond together with low coefficient of thermal expansion and high tensile strength make it extremely attractive as a part of a structure for the effective cooling of X-ray targets. In fact, composite structures based on efficient cooling with the much less conductive graphitized carbon have been suggested in the past. But, until recently, large area diamond crystals were quite expensive. However, the emergence of low pressure CVD diamond technologies make the formation of high quality diamond coatings conforming to specific designs feasible. Additionally, the use of CVD diamond technologies make the formation of single crystalline and polycrystalline diamond coatings attainable. The thermal conductivities of high quality CVD diamond coatings are comparable to that of natural Type IIa diamond (21 W/cm.K at 300 K). This is about five times greater than the thermal conductivity of copper at room temperature. In addition, the thermal conductivity over a wide range of temperatures in artificial diamond may be enhanced by the growth of isotopically pure ($^{12}C$, $^{13}C$ or $^{14}C$) single crystalline diamond. The gain in thermal conductivity for isotopically pure diamond ($^{12}C$) is about 50% over that for natural Type IIa diamond at 300 K. The use of different sources of diamond (natural, ultra-high pressure and CVD technologies) gives the possibility for the design and creation of diamond composite structures and devices. Further possibilities exist for synthesis of diamond-non diamond structures and active/passive devices.

The present patnet application describes the synthesis of structures that permit more efficient cooling due to the high thermal conductivity of diamond. These advantages can be incorporated in conjunction with efficient designs for the use of liquid or gas coolants and anode rotation to further improve the high power generation capabilities of the anode. The structures described herein, detail X-ray production from both single and multiple discrete X-ray sources. In addition, some of the proposed structures can perform both the functions of X-ray production and act as vacuum X-ray windows for the transmission of the generated radiation.

SUMMARY OF THE INVENTION

According to an aspect of the invention, there is provided micromodules having both diamond and non-diamond components for X-ray anodes together with electron beam generation sources which are more simple and yield greater advantages compared to existing methods.

The invention has single crystalline or polycrystalline diamond components joined with conductive non-diamond components for the creation of high efficiency in energy conversion (per unit volume of material) of electron energy to X-rays. This goal is attained by optimizing the geometry of X-ray generation volume to the contact surface area of diamond heat sink. The solution seeks to optimize the surface area between X-ray generating (referred to as active media) and heat conducting media (referred to as passive media). A variation of the invention is the use of at least a portion of the heat conducting medium (diamond) as the window material.

Another feature of the invention is the use of isotopically pure single crystalline diamond at least as a part of the heat conducting volume. The presence of polycrystalline diamond as portion of thermal conductive volume improves the resistance of the micromodules to thermomechanical stresses. One variation of the invention uses lamellar or filamentary electron beams to maximize the effectiveness of thermal contact between active and passive media.

The inventive micromodules also take advantage of the difference in thermal coefficient of expansion between active and passive media to ensure good mechanical and phonon contact in the entire working temperature range.

The configurations shown in the figures can be adapted for static and moving anodes.

DETAILED DESCRIPTION OF THE INVENTION

The X-ray micromodules of FIGS. 1–5 are composed of lamellar shaped X-ray generating materials 1 (active media) surrounded partly or wholly by thermally conductive materials e.g. diamond 2 (passive media). In exclusive heating of the active media by electron bombardment serves to enhance the mechanical and phonon bonding between the active and passive media. The lamellar geometry of the micromodules also facilitate the use of filamentary electron sources as well as X-ray lenses for focussing the generated X-ray beam.

Figure 1:
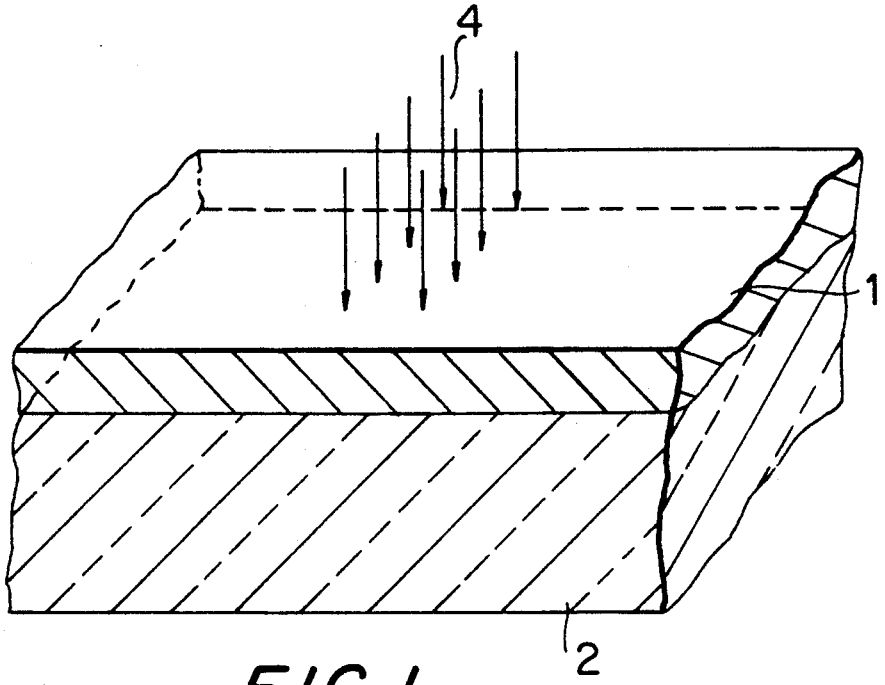
FIG. 1 is a schematic diagram of a micromodule of the invention wherein a thin layer of the desired target material 1 is coated on a diamond substrate 2. An electron beam 3 is impinging on the target material 1.

The micromodule represented in FIG. 1 has the simplest configuration. In this case, the desired target material 1 is coated on a diamond substrate 2 (single crystal or polycrystalline which may or may not be isotopically pure). The micromodule may be operated in a transmission mode, e.g. by the diamond substrate functioning as a vacuum window. The target material may be Cr, Fe, Ni, Mo, Ag, Mg, Al, Rh, W or other metals or alloys, and may be deposited by sputtering, electron beam evaporation or thermal evaporation onto the diamond substrate. The diamond substrate may be deposited with hot wire filament assisted or plasma assisted chemical vapor deposition or by arc jet plasma or oxygen acetylene torch from hydrocarbon gases. The thickness of the target material may be 0.5–25 micrometer, and the thickness of the diamond substrate more than 100 micrometer. An electron beam 4 impinges on the target material.

Figure 2:
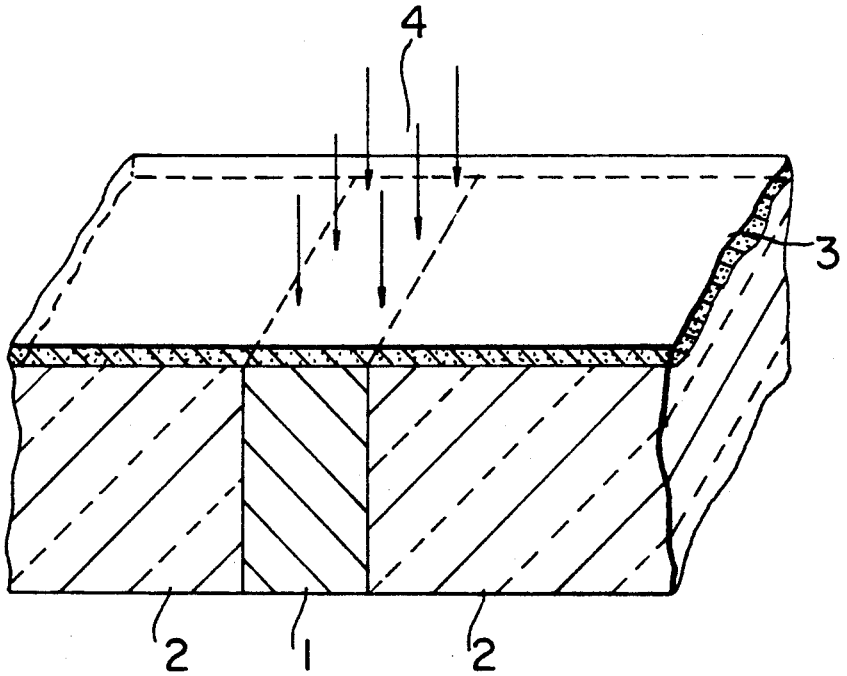
FIG. 2 is a schematic diagram of a micromodule with a thin slice of target material 1 sandwiched between diamond layers 2 and covered with a thin layer of an electrically conducting material 3 to prevent electrostatic charging. An electron beam 4 is impinging on the target material through the conducting surface coating.

The micromodule, schematically shown in FIG. 2, is capable of functioning for the generation of X-rays in directions both towards and away from the electron beam. The micromodule has a thin layer of the desired target material 1 sandwiched between diamond layers 2. The diamond layers may be single crystal or polycrystalline and may be synthesized isotopically pure to improve the efficiency of heat conduction. Thermal contact between the diamond and target material may also be enhanced by appropriate treatments to improve adhesion and plasticity of target layer. An advantage of this geometry is the nearly maximum proximity of active and passive media. The module is coated with a thin conducting layer 3 to prevent charging effects. The conducting layer can be from 100 Angstrom to 1 micrometer thick and made from light elements, such as Al, Mg or conducting carbon. The conducting layer may be deposited with sputtering, electron-beam evaporation or thermal evaporation. The conducting layer may also be generated by irradiating the diamond surface with a high intensity ion or laser beam, e.g. excimer laser, to cause a phase transition to conducting carbon or graphite. The electron beam may be a linear beam with a cross-section approximately equal to the width of the target material, or a scanning electron beam.

The electron beam 4 impinging on the target material may be a linear beam or a scanning beam impinging normally on the target material through the conducting surface coating. Since the surface coating is thin, only a negligible amount of X-rays will be generated in the surface coating itself.

Figure 3:
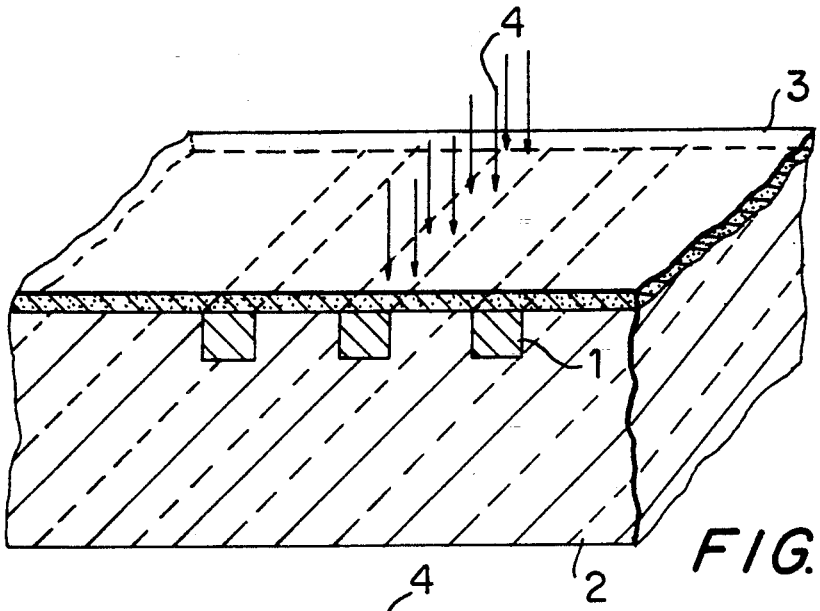
FIG. 3 is a schematic diagram of a micromodule with grooves in a diamond layer 2 filled with target material 1 and coated with a thin layer of conducting material 3. An electron beam 4 is impinging on the target material through the conducting surface coating.

The micromodule shown in FIG. 3 is a variation of the one in FIG. 2. This seeks to maximize the heat sinking properties of the passive media by optimizing the size and interrelated geometry of the X-ray generating and thermal conductive media. In this case, the target layer(s) 1 are deposited/filled in grooves formed in the diamond body 2. The grooves, may be rectangular or circular or of any appropriate desired shape and may be produced by ion milling or laser ablation. An advantage of this design, is the possibility for selectively filling grooves with different materials, thereby creating a multiple target anode. The selective filling of the grooves may be done by first coating the surface of the diamond substrate with a thin layer of a material, e.g. Au, which has poor adhesion to diamond, prior to the formation of the grooves. The grooves are subsequently filled by the desired target material by e.g. sputtering, which also coats the entire surface. The surface coating is removed by polishing the target, leaving only the grooves filled with the desired target material. The desired target material may be chosen by focussing the electron beam on a particular groove. The width of the grooves may be 0.5–30 micrometer and the depth of the grooves 0.5–20 micrometer. The module is coated with a thin conducting layer as in FIG. 2 to prevent surface charging. The electron beam may be a linear beam with a cross-section approximately equal to the width of the target material, or a scanning electron beam.

Figure 4:
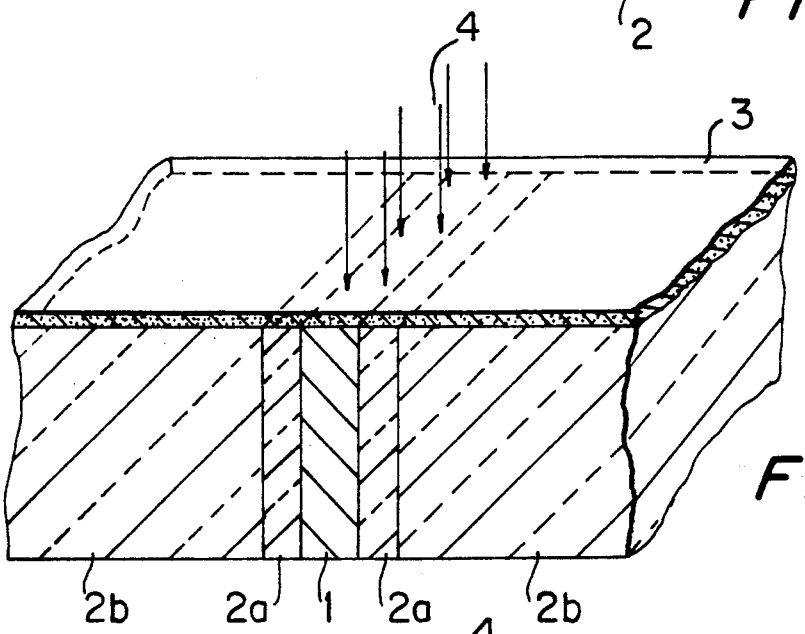
FIG. 4 is a schematic diagram of a micromodule with a target material 1 sandwiched between two layers of isotopically pure diamond 2 which is flanked by diamond or metallic layers 3 and coated with a thin layer of conducting material 4. An electron beam 5 is impinging on the target material through the conducting surface coating.

Economic and more efficient cooling of target(s) 1 may be obtained by sandwiching layer(s) between layers of more expensive single crystal diamond 2a (which may or may not be isotopically pure) adjacent to the target and polycrystalline diamond 2b as represented in FIG. 4. The width of the target material 1 may be 0.5–30 micrometer, the width of the isotopically pure layer 2a greater than 1 micrometer and the width of the flanking diamond layer 2b greater than 100 micrometer. The thickness of the module is greater than 50 micrometer. The module is coated with a thin conducting layer 3 as in FIG. 2 to prevent surface charging. The electron beam 4 may be a linear beam with a cross-section approximately equal to the width of the target material, or a scanning electron beam.

Figure 5:
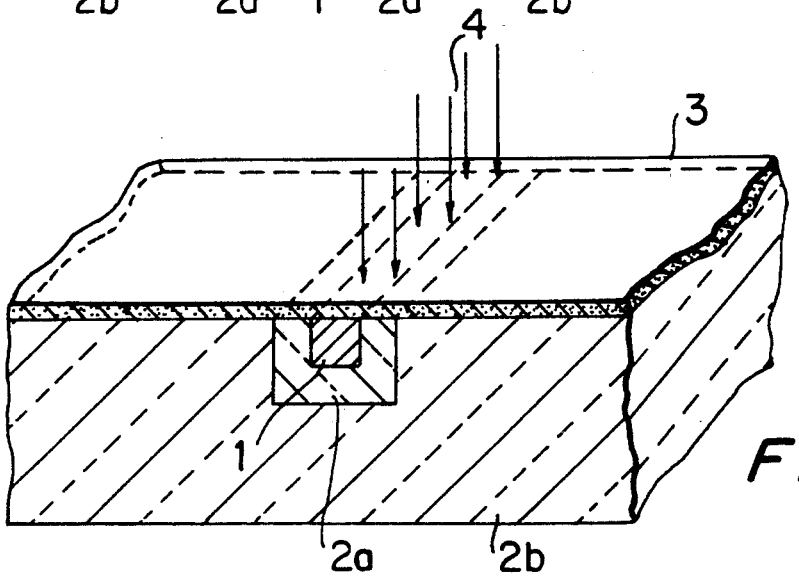
FIG. 5 is a schematic diagram of a micromodule with a thin layer of target material 1 embedded in an isotopically pure monocrystalline diamond layer 2 lying in a diamond body 3 and coated with a thin layer of a conducting material 4. An electron beam 5 is impinging on the target material through the conducting surface coating.

The micromodule represented in FIG. 5 is another variation. In this case, the target layer(s) 1 is (are) embedded in a single crystal diamond (isotopically pure if required) body 2a. The single crystal diamond is flanked by diamond layers 2b. The dimensions of the target and the substrate are similar to those of FIG. 3. The depth and width of the diamond body 2a is greater than 1 micrometer. The electron beam 4 may be a linear beam with a cross-section approximately equal to the width of the target material, or a scanning electron beam.

In all cases, the charging problem on the surface may be overcome by coating a thin layer of conducting material 3 up to a few hundred angstroms thickness.

Some specific Examples of applications of anode sets based on X-ray sources include the following:

EXAMPLE 1

High Resolution X-ray Computer Tomography

X-ray tubes for microtomography normally use electron beams with accelerating voltage in the 100–200 kV energy range. For high resolution tomography (for instance better than 10 microns) it is desirable to have the focus spot dimension of the same order as the resolution. An electron beam irradiating, for example, a micromodule according to FIG. 2, with target about 10 microns wide, is decelerated by the target material. For a tungsten target and an electron beam with an accelerating voltage of 120 kV energy, full deceleration takes place at a thickness of about 34 microns. However, the depth of the layer within which maximal intensity of high energy component of X-ray spectrum in generated is about 11 micrometers. The thickness of the target layer 1 is optimally in this example about 11 micrometers.

Heat generated in the target material is dissipated by the diamond body which is in thermal contact with the target. Maximum evolution of heat takes place within a layer between 11–34 microns from the surface of the target. Some X-ray radiation will be generated in the diamond body adjacent to the target. This does not have a significant influence on the formation of the tomographic image. For X-ray computed tomography, the desired X-ray beam angle is about 4 degrees. In this case, X-ray extraction is observed at angles from 3 to 7 degrees with respect to the anode surface along the direction of line focus. Therefore along one direction, the size of the focus spot projection is the same as the width of the target layer. Along the second dimension it is about ten times smaller than the length of line focus. The desired size of focus spot can be achieved by appropriate changes in dimensions in the same geometry. Further, the stability of the focus spot area is fairly independent of electrical parameters of the electron gun and focussing system.

In a specific example, with an 11 micrometer tungsten layer as the target material deposited by electron beam evaporation onto a 200 micrometer diamond substrate, 70 W of x-ray power was generated by an electron beam with an acclerating voltage of 80 kV and a 20 micrometer diameter spot size. The target was stationary and water cooled. This compares with approximately 10 W of power generated by a standard x-ray anode using a similar electron beam source.

Additional power can be generated by using a linear electron beam, thereby irradiating a larger surface area of the W target, or by incorporating the target design into a rotating anode configuration.

EXAMPLE 2

X-ray Topography and X-ray Diffraction

For this application, the accelerating voltage normally employed is around 30–60 kV. A wide range of target materials are used depending on the composition of the crystal to be examined. For increased resolution a point projection of the focus spot is desired. It is generally cumbersome to replace target materials for investigating different types of crystals. From this point of view, a composite anode based on a variation of the micromodule according to FIG. 3 may be employed. In this variation, the grooves are filled with different target materials, offering a selection of a variety of X-ray sources. The distance between the grooves is much greater than the width of each individual groove. Desired X-ray radiation can be obtained by transferring the electron beam to the desired target material. With 50–60 kV accelerating voltage, the x-ray generation takes place within a thickness of 5 micrometers for Cr, 3 micrometers for Mo and 3 micrometers for Ag.

EXAMPLE 3

X-ray Lithography

High intensity of radiation and areal stability of X-ray generators with wavelengths of about 8–10 Angstroms are major requirements for X-ray lithography using proximity printing. For projection printing, 40–50 Angstrom radiation may be used. For x-ray lithography, a micromodule according to FIG. 4 may be most suited. The width of the separation of the two polycrystalline diamond regions 3, filled with isotopically pure single crystal diamond 2 and target material 1, exceeds the width of the electron beam bombarding the target layer 1. This ensures extremely good heat conduction allowing the extraction of extremely high intensity X-rays. If the target material is diamond, X-ray radiation of 44 Angstrom wavelength is produced, which is suitable for projection printing.

What is claimed is:

1. An x-ray micromodule comprising a layer of target material (1) sandwiched between diamond layers (2).

2. A micromodule comprising grooves in a diamond substrate (2) with target material (1) in said grooves.

3. A micromodule according to claim 1, wherein said diamond layers are of isotopically pure diamond, and further comprising flanking diamond layers (26) on said isotopically pure layers (2a).

4. A micromodule according to claim 1, further comprising a covering surface on said micromodules of a thin layer of conductive material, up to a few hundred angstroms thick, to prevent charging of the surface.

5. A micromodule according to claim 1, comprising the use of isotopically pure $^{12}C$, $^{13}C$ or $^{14}C$ to synthesize the diamond layer.

6. A micromodule according to claim 1 wherein said layer of target material is 0.5 to 25 micrometers in thickness.

* * * * *